US006396203B1

(12) United States Patent
Aibara et al.

(10) Patent No.: US 6,396,203 B1
(45) Date of Patent: May 28, 2002

(54) COLOR SHADOW MASK ASSEMBLY WITH INCREASED RESISTANCE TO HEAT AND VIBRATION

(75) Inventors: Nobumitsu Aibara; Akira Shishido; Takashi Magoi; Tadayuki Nishimura, all of Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/116,595

(22) Filed: Jul. 16, 1998

(30) Foreign Application Priority Data

Jul. 24, 1997 (JP) ..... 9-198306

(51) Int. Cl.[7] ..... H01J 29/80
(52) U.S. Cl. ..... 313/402; 313/407; 313/408
(58) Field of Search ..... 313/402, 403, 313/407, 408, 404, 405, 406

(56) References Cited

U.S. PATENT DOCUMENTS 3,772,555 A * 11/1973 McKee et al. ..... 313/404
5,072,151 A * 12/1991 Spina ..... 313/402
5,235,243 A * 8/1993 Tong ..... 313/402
5,327,043 A * 7/1994 Lambert ..... 313/402
5,576,595 A * 11/1996 Inoue ..... 313/402
5,625,251 A * 4/1997 Nosker et al. ..... 313/403
5,936,336 A * 8/1999 Shishido et al. ..... 313/402

FOREIGN PATENT DOCUMENTS

JP 1117245 * 5/1989 ..... 313/365

* cited by examiner

*Primary Examiner*—Nimeshkumar D. Patel
*Assistant Examiner*—Mariceli Santiago
(74) *Attorney, Agent, or Firm*—Whitham, Curtis & Christofferson, P.C.

(57) ABSTRACT

A color shadow mask assembly includes a shadow mask spaced apart from an inner surface of a face panel by a predetermined gap and having a curved surface, and a rectangular frame for supporting and fixing the shadow mask. The shadow mask and the frame are integrally formed by welding to fix a side wall of the frame to a skirt of the face panel. The skirt alternately overlaps inner and outer surfaces of the side wall of the frame at opposite surfaces between the skirt of the shadow mask and the side wall of the frame.

4 Claims, 4 Drawing Sheets

COLOR SHADOW MASK ASSEMBLY WITH INCREASED RESISTANCE TO HEAT AND VIBRATION

BACKGROUND OF THE INVENTION

1. Field of the Invention

The present invention relates to a color shadow mask assembly and, more particularly, to a color shadow mask assembly excellent in heat resistance and vibration resistance.

2. Description of the Prior Art

FIG. 1 is a sectional view of the main part of a conventional color cathode-ray tube. Generally, in a color cathode-ray tube 12, phosphor films 4 and a shadow mask assembly 15 are sequentially disposed. The phosphor films 4 are formed on the inner surface of a face panel 3 constituting the front surface portion of a bulb 2. The shadow mask assembly 15 is constituted by a shadow mask 16 and a frame 17 for supporting and fixing the shadow mask 16. Electron beams 11 emitted from an electron gun 9 disposed in the neck of the bulb 2 are deflected by a magnetic field formed by a deflecting yoke 10 to scan the phosphor films 4 through the shadow mask 16, thereby displaying an image.

Only the shadow mask assembly will be described to compare it with the present invention. As shown in FIG. 1, originally, the shadow mask 16 serves to select the three electron beams that have passed through respective electron beam passing holes 16*d*, such that they correctly land on the phosphor films 4 of three predetermined colors. Accordingly, this shadow mask 16 must always maintain a predetermined relationship with the phosphor films 4.

FIG. 2 is a perspective view of the shadow mask. The shadow mask 16 has an aperture region 16*a* and a non-aperture region 16*b*, both of which are formed of a curved surface. A skirt 16*c* is arranged in the periphery of the shadow mask 16. The large number of dot-like or rectangular electron beam passing holes 16*d* are formed in the aperture region 16*a* of the shadow mask 16 to pass the electron beams therethrough.

As shown in FIG. 1, the electron beams 11 that reach the phosphor films 4 through the electron beam passing holes 16*d* of the shadow mask 16 are merely about 15% to 25% the total electron beams emitted from the electron gun 9, and most of the remaining electron beams collide against the shadow mask 16 to heat it. When the temperature of the shadow mask 16 increases, the position of the shadow mask 16 relative to the phosphor films 4 changes due to thermal expansion, and the landing positions of the electron beams 11 on the three-color phosphor films 4 displace. When this positional displacement exceeds the upper limit of an allowable range, the purity of color is degraded.

FIGS. 3A and 3B are sectional views of the main part of the shadow mask assembly taken along the vertical direction. The shadow mask assembly 15 is integrally formed by welding the predetermined positions of the skirt 16*c* of the shadow mask 16 and the predetermined positions of a side wall 17*a* of the frame 17 with each other. In this case, the combinations of the shadow mask 16 and frame 17 include the inner mask type shown in FIG. 3A and the outer mask type shown in FIG. 3B.

According to the inner mask type, as shown in FIG. 3A, the skirt 16*c* of the shadow mask 16 is arranged to oppose the inner surface of the side wall 17*a* of the frame 17. According to the outer mask type, as shown in FIG. 3B, the skirt 16*c* of the shadow mask 16 is arranged to oppose the outer surface of the side wall 17*a* of the frame 17, which is opposite to the inner mask type.

In either of the inner mask type and the outer mask type described above, the skirt 16*c* of the shadow mask 16 and the side wall 17*a* of the frame 17 overlap each other, and thereafter the predetermined positions of the overlapping portions are fixed by welding. These two types have individual characteristic features. For example, in the inner mask type, although the aperture area is small, the contact area through which the skirt 16*c* of the shadow mask 16 inscribes the side wall 17*a* of the frame 17 is designed to be large, so that the vibration of the shadow mask 16 at the natural frequency is suppressed. Hence, this type stands vibration. In the outer mask type, the aperture area is large. When this advantage is seen on the other way round, however, this type is weak to vibration.

In the color shadow mask assembly described above, the fitting state between the shadow mask and the frame sometimes leads to degradation in purity of color due to the landing displacement caused by thermal expansion and degradation in quality of the screen due to heat or vibration.

SUMMARY OF THE INVENTION

The present invention has been made in view of the above problems, and has as its object to provide a color shadow mask assembly in which a means for increasing the aperture area and improving the heat resistance and vibration resistance is provided, so that the influences of heat and vibration to the shadow mask assembly are suppressed.

In order to achieve the above object, according to the present invention, there is provided a color shadow mask assembly comprising a shadow mask spaced apart from an inner surface of a face panel by a predetermined gap and having a curved surface, and a rectangular frame for supporting and fixing the shadow mask, the shadow mask and the frame being welded and integrally formed to fix a side wall of the frame to a skirt of the face panel, wherein the skirt alternately overlaps inner and outer surfaces of the side wall of the frame at opposite surfaces between the skirt of the shadow mask and the side wall of the frame.

According to the second aspect of the present invention, there is provided a color shadow mask assembly according to the first aspect wherein, in a structure in which the skirt alternately overlaps the inner and outer surfaces of the side wall of the frame, the skirt overlaps the outer surface of the side wall of the frame at four corners of the frame.

According to the third aspect of the present invention, there is provided a color shadow mask assembly according to the first aspect, wherein, in a structure in which the skirt alternately overlaps the inner and outer surfaces of the side wall of the frame, the skirt overlaps the outer surface of the side wall of the frame at a total of not less than five portions including four corners of the frame and at least one of four sides of the frame.

According to the fourth aspect of the present invention, there is provided a color shadow mask assembly according to the first aspect wherein, in a structure in which the skirt alternately overlaps the inner and outer surfaces of the side wall of the frame, the skirt overlaps the outer surface of the side wall of the frame at a total of eight portions including four corners and four sides of the frame.

According to the fifth aspect of the present invention, there is provided a color shadow mask assembly according to the first aspect, wherein the side wall of the frame is formed with recesses and projections.

As described above, in the shadow mask assembly according to the present invention, recesses and projections are formed at at least the four corners and four sides of the side wall of the frame. The skirt of the shadow mask is fitted and inserted between the four corners and the projecting sides. Thereafter, the predetermined portions of opposing surfaces between the skirt of the shadow mask and the side wall of the frame are fixed to each other by welding. Both the conventional outer mask type and inner mask type are employed to provide a compound type shadow mask having the advantages of the two types.

More specifically, in the shadow mask assembly according to the present invention, since the opposing surfaces between the skirt of the shadow mask and the side wall of the frame are alternately inscribed and circumscribed, influences caused by heat or vibration can be suppressed. As a result, a shadow mask assembly excellent in heat resistance and vibration resistance because of its structure and having a wide aperture region can be provided.

The above and many other objects, features and advantages of the present invention will become manifest to those skilled in the art upon making reference to the following detailed description and accompanying drawings in which preferred embodiments incorporating the principles of the present invention are shown by way of illustrative examples.

BRIEF DESCRIPTION OF THE DRAWINGS

FIGS. 3A and 3B are sectional views of the main part of the conventional shadow mask assembly, in which FIG. 3A shows an inner mask type structure and FIG. 3B shows an outer mask type structure;

FIGS. 4A to 4C are views respectively showing the main part of a shadow mask assembly according to the first embodiment of the present invention, in which FIG. 4A is a sectional view taken along a plane parallel to the shadow mask surface, FIG. 4B is a sectional view taken along the line IVB—IVB of FIG. 4A, and FIG. 4C is a sectional view taken along the line IVC—IVC of FIG. 4A;

DETAILED DESCRIPTION OF THE PREFERRED EMBODIMENTS

Figure 1:
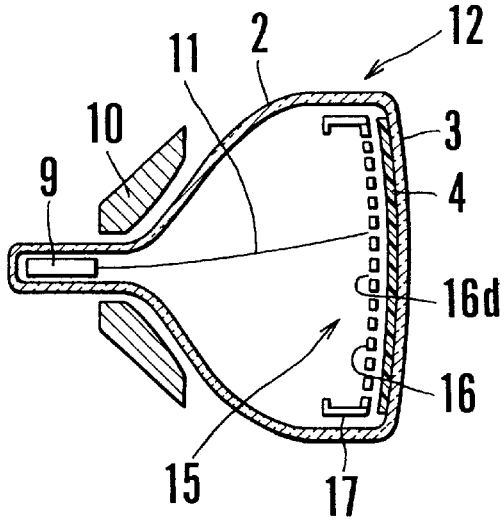
FIG. 1 PRIOR ART
FIG. 1 is a sectional view of the main part of a conventional color cathode-ray tube.
Figure 2:
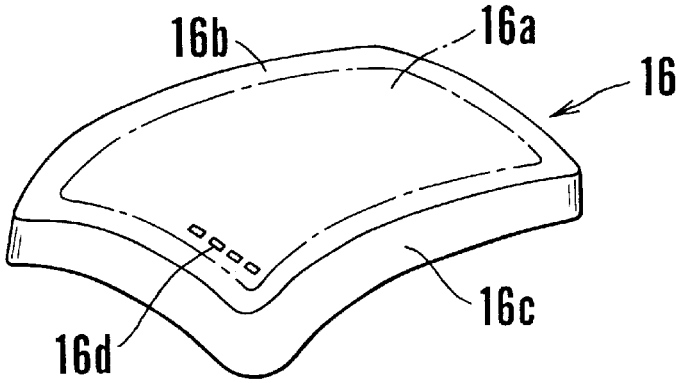
FIG. 2 PRIOR ART
FIG. 2 is a perspective view of a conventional shadow mask assembly used in the color cathode-ray tube.
Figure 3A:
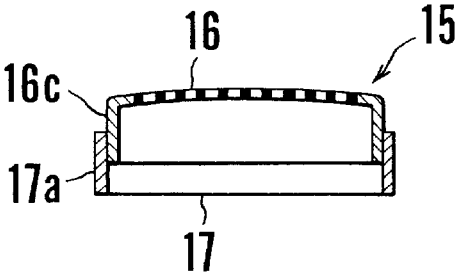
FIG. 3A PRIOR ART
Figure 3B:
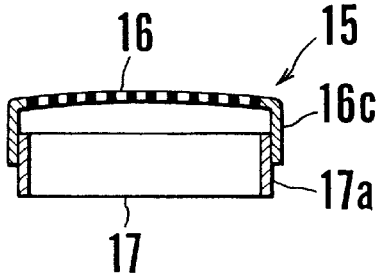
FIG. 3B PRIOR ART

Several preferred embodiments of the present invention will be described with reference to the accompanying drawings. FIGS. 4A to 4C, FIGS. 5 and 6, and FIGS. 7A and 7B show shadow mask assemblies according to the present invention.

Referring to these drawings, reference numeral 5 denotes a shadow mask assembly constituted by a shadow mask and a frame; 6, a shadow mask; 6*a,* an aperture region; 6*b,* a non-aperture region; 6*c,* a skirt; 6*d,* electron beam passing holes; 7, a frame for supporting and fixing the shadow mask 6; 7*a,* the side wall of the frame 7; 7*b,* four corners of the frame 7; and 7*c,* the projections of the frame 7.

The major characteristic feature of the present invention resides in that the shape and structure of the frame 7 are changed so that both the outer and inner mask types described in the prior art are employed, thereby providing the compound type shadow mask assembly 5 having the advantages of the both types.

More specifically, where the skirt 6*c* of the shadow mask 6 and the side wall 7*a* of the frame 7 oppose each other, the skirt 6*c* alternately overlaps the inner and outer surfaces of the side wall 7*a* of the frame 7.

Figure 4A:
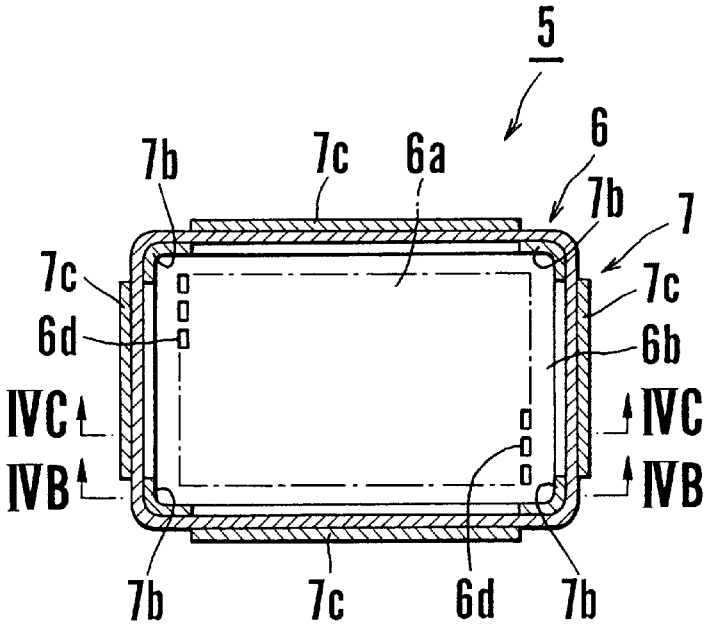
Figure 4B:
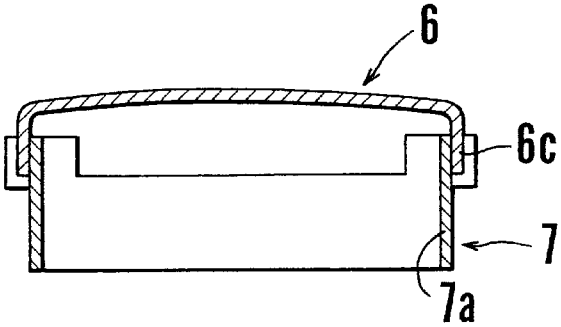
Figure 4C:
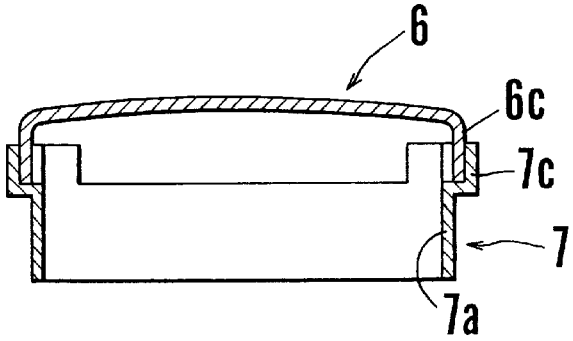

The first embodiment of the present invention will be described. FIGS. 4A to 4C are sectional views showing the main part of a shadow mask assembly according to the first embodiment of the present invention, in which FIG. 4A is a sectional view taken along a plane parallel to the shadow mask surface, FIG. 4B is a sectional view taken along the line IVB—IVB, close to four corners, of FIG. 4A, and FIG. 4C is a sectional view taken along the line IVC—IVC of FIG. 4A.

As shown in FIGS. 4A to 4C, when overlapping the skirt 6*c* of the shadow mask 6 and the side wall 7*a* of the frame 7 each other, at the four corners 7*b* of the frame 7, the skirt 6*c* of the shadow mask 6 opposes the outer surface (outer side) of the side wall 7*a* of the frame 7, and at the respective straight sides other than the four corners 7*b,* the skirt 6*c* of the shadow mask 6 opposes the inner surface (inner side) of the side wall 7*a* of the frame 7. In this manner, at the four corners 7*b* of the frame 7, the skirt 6*c* of the shadow mask 6 is located on outer surface (outer side), whereas at the other four straight sides, the skirt 6*c* of the shadow mask 6 is located on the inner surface (inner side), providing a compound type as the combination of the outer mask type and the inner mask type.

The second embodiment of the present invention will be described.

Figure 5:
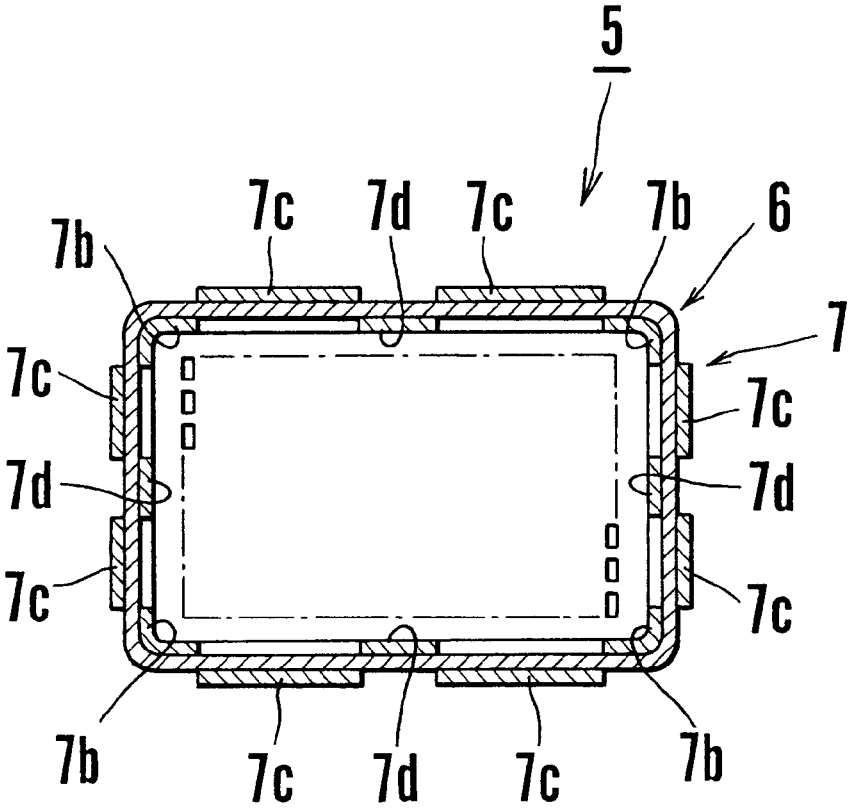
FIG. 5 is a sectional view showing the main part of the second embodiment of the present invention and taken at the same position as in FIG. 4A.

FIG. 5 is a sectional view of the main part of a shadow mask assembly according to the second embodiment of the present invention. As shown in FIG. 5, in this embodiment, projecting sides, where a skirt 6*c* of a shadow mask 6 identical to that shown in the first embodiment is located on the outer surface (outer side) of a side wall 7*a* of a frame 7, are added on the four straight sides of the frame, in addition to those on four corners 7*b* of the frame 7. As shown in FIG. 5, in this embodiment, portions where the skirt 6*c* of the shadow mask 6 is located on the outer surface of the side wall 7*a* of the frame 7 are respectively added and formed at substantially the central portions of all the straight sides including longer and shorter sides, thus obtaining a total of 8 portions. Depending on the condition under which the shadow mask assembly is used, the same effect can be obtained by forming a projecting side on one of the four straight sides.

Figure 6:
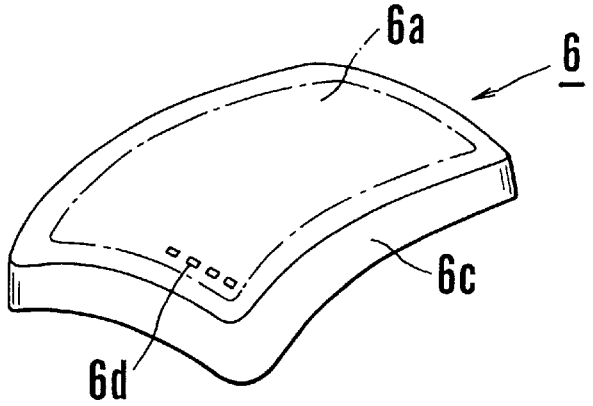
FIG. 6 is a perspective view showing a shadow mask according to the present invention.
Figure 7A:
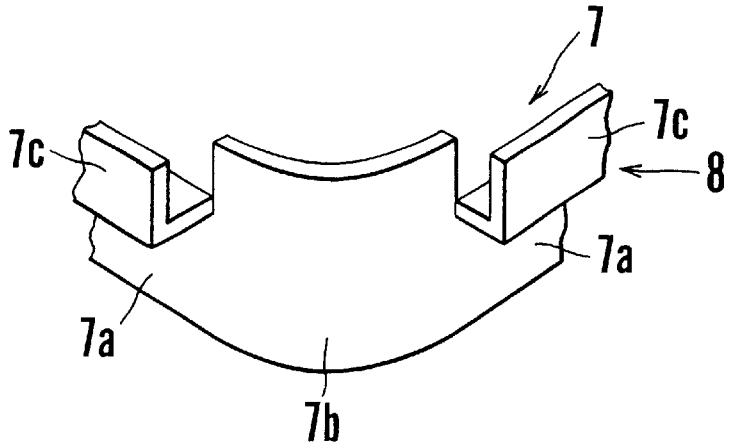
FIGS. 7A and 7B are partially enlarged perspective views of the frame portions of shadow mask assemblies according to the first and second embodiments, respectively, of the present invention.
Figure 7B:
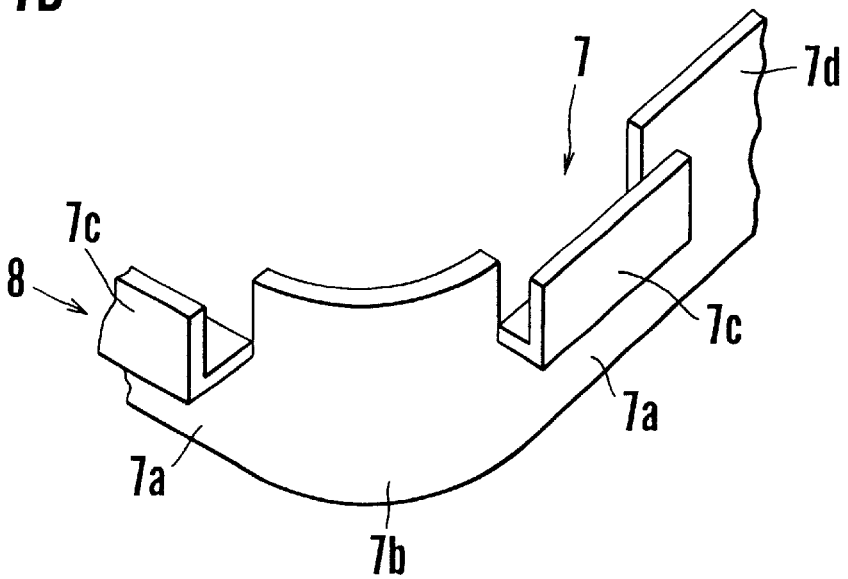

FIG. 6 is a perspective view of the shadow mask. FIG. 7A is a partially enlarged perspective view showing the shape of one of the four corners of the frame 7 according to the first embodiment, and FIG. 7B is a partially enlarged perspective view showing the shapes of one of the four corners and a side of the frame 7 according to the second embodiment.

How to overlap the shadow mask 6 and frame 7 each other will be described with reference to FIG. 6 and FIGS. 7A and 7B. According to the present invention, the shadow mask 6 shown in FIG. 6 is arranged such that its skirt 6*c* is inserted and placed between the inner surfaces of the projecting sides 7*c* of the frame 7, where the side wall 7*a* of the frame 7 relatively forms projections and recesses, and an outer surface 8*b* of the recessed sides 7*b* and 7*d* of the frame 7, as shown in FIG. 7A or 7B.

After the shadow mask 6 is placed on the frame 7 and overlapped on it, the shadow mask 6 is fixed by welding at its predetermined positions. Although not shown, a hook spring is fixed by welding at a predetermined position to form the shadow mask assembly 5. As described above, the shadow mask assembly 5 according to the present invention has a compound type structure in which both the outer mask type and the inner mask type are employed on the basis that the structure of the side wall 7*a* of the frame 7 is altered.

In the compound type shadow mask assembly 5 described above, the contact portion between the skirt 6*c* of the shadow mask 6 and the side wall 7*a* of the frame 7 is large, so that the vibration at the natural frequency can be suppressed, which is the advantage of the inner mask type. Simultaneously, the aperture area of the outer mask can be increased, which is the advantage of the outer mask type. Hence, the advantages of both the conventional inner mask type and outer mask type are obtained.

When recesses and projections are formed in the side wall 7*a* of the frame 7 described above, the gap between the projections 7*c* and the recesses 7*b* that sandwich the skirt 6*c* of the shadow mask 6 is sufficient if it is slightly larger than the thickness of the shadow mask 6.

What is claimed is:

1. A color shadow mask assembly, comprising:

a shadow mask spaced from an inner surface of a face panel by a predetermined gap and having a curved surface, and a rectangular frame for supporting and fixing said shadow mask, said frame having a peripheral wall fixed to a skirt of said shadow mask, said peripheral wall includes at least four projecting side wall portions and at least four recessed side wall portions, wherein said skirt overlaps inner surfaces of said at least four projecting side wall portions and overlaps outer surfaces of said at least four recessed side wall portions of said frame, and wherein one of said at least four projecting side wall portions and said at least four recessed side wall portions is located at respective corners of said frame and the other of said at least four projecting side wall portions and said at least four recessed side wall portions is located along both long and short sides of said frame.

2. A color shadow mask assembly according to claim 1, wherein said recessed side wall portions are located at respective ones of said corners of said frame and said projecting side wall portions are located along both long and short sides of said frame.

3. A color shadow mask assembly according to claim 1, wherein said peripheral wall includes eight projecting side wall portions, pairs of which are located along both long and short sides of said rectangular frame.

4. A color shadow mask assembly according to claim 1, further comprising:

weld joints for fixing said recessed and projecting side wall portions to said skirt.

* * * * *